US010556426B2

(12) United States Patent
Sakuyama

(10) Patent No.: US 10,556,426 B2
(45) Date of Patent: Feb. 11, 2020

(54) PRINTING APPARATUS

(71) Applicant: CANON FINETECH NISCA INC., Misato-shi (JP)

(72) Inventor: Masayoshi Sakuyama, Nagareyama (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 16/020,108

(22) Filed: Jun. 27, 2018

(65) Prior Publication Data

US 2019/0009530 A1 Jan. 10, 2019

(30) Foreign Application Priority Data

Jul. 4, 2017 (JP) ..... 2017-131167
Jun. 22, 2018 (JE) ..... 2018-118969

(51) Int. Cl.

*B41J 2/045* (2006.01)
*B41J 11/00* (2006.01)
*B41J 13/00* (2006.01)
*B41J 11/42* (2006.01)

(52) U.S. Cl.

CPC ..... *B41J 2/04573* (2013.01); *B41J 2/04586* (2013.01); *B41J 11/008* (2013.01); *B41J 13/0027* (2013.01); *B41J 11/007* (2013.01); *B41J 11/42* (2013.01)

(58) Field of Classification Search

CPC ..... B41J 2/04573; B41J 2/04505; B41J 2/04551; B41J 2/04586; B41J 2/2132; B41J 2/2135; B41J 2/51; B41J 11/0055; B41J 11/007; B41J 11/04; B41J 11/44; B41J 12/01; B41J 11/0095; B41J 11/008; B41J 13/0027; B41J 11/42; B41J 13/0009

See application file for complete search history.

(56) References Cited

U.S. PATENT DOCUMENTS

| | | | | |
|---|---|---|---|---|
| 9,392,136 | B2 | 7/2016 | Fukui | |
| 9,555,991 | B2 * | 1/2017 | Staehli | B65H 5/062 |
| 9,751,342 | B2 * | 9/2017 | Kurane | B41J 11/0095 |
| 2018/0207961 | A1 * | 7/2018 | Mori | B41J 13/0027 |

FOREIGN PATENT DOCUMENTS

| | | | |
|---|---|---|---|
| JP | 08-142431 | A | 6/1996 |
| JP | 2013-059869 | A | 4/2013 |

* cited by examiner

*Primary Examiner* — Thinh H Nguyen
(74) *Attorney, Agent, or Firm* — Venable LLP

(57) ABSTRACT

A printing apparatus includes a first roller pair disposed upstream of a print head; a second roller pair disposed downstream of the print head in the conveyance direction; and a controller configured to control the print head so as to perform an ejection operation at an ejection timing according to the rotation detected by a rotation detecting unit when the first roller pair conveys the print medium at a first conveyance speed before the second roller pair holds the print medium and when the second roller pair conveys the print medium at a second conveyance speed while holding the print medium and the first roller pair idly rotates by a one-way clutch.

7 Claims, 13 Drawing Sheets

PRINTING APPARATUS

BACKGROUND OF THE INVENTION

Field of the Invention

The present invention relates to a printing apparatus for printing an image on a conveyed print medium.

Description of the Related Art

Some printing apparatuses convey a print medium on a conveyance path for the print medium with holding the print medium being held respectively by a roller pair disposed upstream of a print head and a roller pair disposed downstream thereof, and ejecting ink from the print head to the conveyed print medium so as to form an image on the print medium. In these printing apparatuses, the rotational speed of the downstream roller pair is generally set to be higher than that of the upstream roller pair, and furthermore, the nip pressure of the downstream roller pair is set to be lower than that of the upstream roller pair. Accordingly, when the print medium is conveyed while held by both of the roller pairs, the print medium is conveyed at the conveyance speed according to the upstream roller pair having the higher nip pressure, and furthermore, the downstream roller pair having the lower nip pressure, although the rotational speed is higher, slides on the conveyed print medium so as to exert tension on the print medium to be conveyed, thus preventing the print medium from sagging between both of the roller pairs. However, with such a conveyance mechanism, when the rear end of the print medium goes out of the upstream roller pair, the conveyance speed of the print medium so far becomes a conveyance speed by the downstream roller pair rotated at a rotational speed higher than that of the upstream roller pair. As a consequence, conveyance speed fluctuations of the print medium largely occur during ejecting ink from the print head, thereby inducing mis-registration or the like of a print position, so as to degrade a resultant image.

In order to solve the above this problem, Japanese Patent Laid-Open No. H08-142431 (1996) discloses that each of upstream and downstream roller pairs is provided with an encoder for detecting rotation. The encoder detects a difference in speed generated in both of the roller pairs when the rear end of a print medium goes out of the upstream roller pair, and then, changes a conveyance speed by the downstream roller pair to as low a speed as the conveyance speed by the upstream roller pair based on the detection result. Alternatively, Japanese Patent Laid-Open No. 2013-59869 discloses that each of upstream and downstream roller pairs is provided with a rotation detecting encoder for detecting the rotation of each of the roller pairs. Ejection is controlled on the assumption that during a predetermined period of time before and after the rear end of a print medium goes out of the upstream roller pair, a print medium is conveyed at a provisional conveyance speed V3 calculated based on a conveyance speed V1 of the upstream roller pair and a conveyance speed V2 by the downstream roller pair without using an actual value measured by the encoder, which cannot follow a change in exponential speed immediately after the rear end of a print medium goes out of the upstream roller pair.

However, with the configuration in which the rear end of a print medium goes out of the upstream roller pair, and then, a difference in speed between respective roller pairs is detected such that the conveyance speed by the downstream roller pair is switched to the conveyance speed by the both of the roller pairs, as disclosed in Japanese Patent Laid-Open No. H08-142431 (1996), a speed during switching to the conveyance speed of the upstream roller pair may not match an ink ejection timing. Specifically, when an ink ejection timing is made to be synchronous with the switched conveyance speed by the upstream roller pair, the ink ejection timing and the conveyance speed do not match each other until the time of the completion of speed switch. As a consequence, there is a possibility of mis-registration of an ink position on a print medium. Japanese Patent Laid-Open No. 2013-59869 discloses that ejection is controlled on the assumption that a print medium is conveyed at the calculated provisional conveyance speed V3 during a predetermined period of time before and after the rear end of the print medium goes out of the upstream roller pair. The conveyance speed V3 is a calculated provisional speed. Therefore, the conveyance speed V3 may be different from an actual conveyance speed. As a consequence, the ink ejection timing and the conveyance speed do not match each other, thereby possibly inducing mis-registration of an ink position on a print medium.

SUMMARY OF THE INVENTION

An object of the present invention is to provide a printing apparatus capable of preventing the degradation of an image caused by a difference in speed between an upstream roller pair and a downstream roller pair.

In order to achieve the above-described object, a printing apparatus according to the present invention is featured by including: a print head configured to eject liquid onto a print medium; a first roller pair disposed upstream of the print head in a conveyance direction of the print medium, the first roller pair being configured to convey the print medium to an ejection position of the print head at a first conveyance speed by driving force transmitted via a one-way clutch while holding the print medium; a second roller pair disposed downstream of the print head in the conveyance direction, the second roller pair being configured to convey the print medium downstream in the conveyance direction at a second conveyance speed that is higher than the first conveyance speed while holding the print medium; a first rotation detecting unit configured to detect the rotation of rollers in the first roller pair; and a control unit configured to control the print head so as to perform ejection operation at an ejection timing according to the rotation detected by the first rotation detecting unit when the first roller pair conveys the print medium at the first conveyance speed before the second roller pair holds the print medium and when the second roller pair conveys the print medium at the second conveyance speed while holding the print medium whereas the first roller pair idly rotates by the one-way clutch.

Further features of the present invention will become apparent from the following description of exemplary embodiments with reference to the attached drawings.

DESCRIPTION OF THE EMBODIMENTS

Preferred embodiments according to the present invention will be explained in detail with reference to the attached drawings.

First Embodiment

Figure 1:
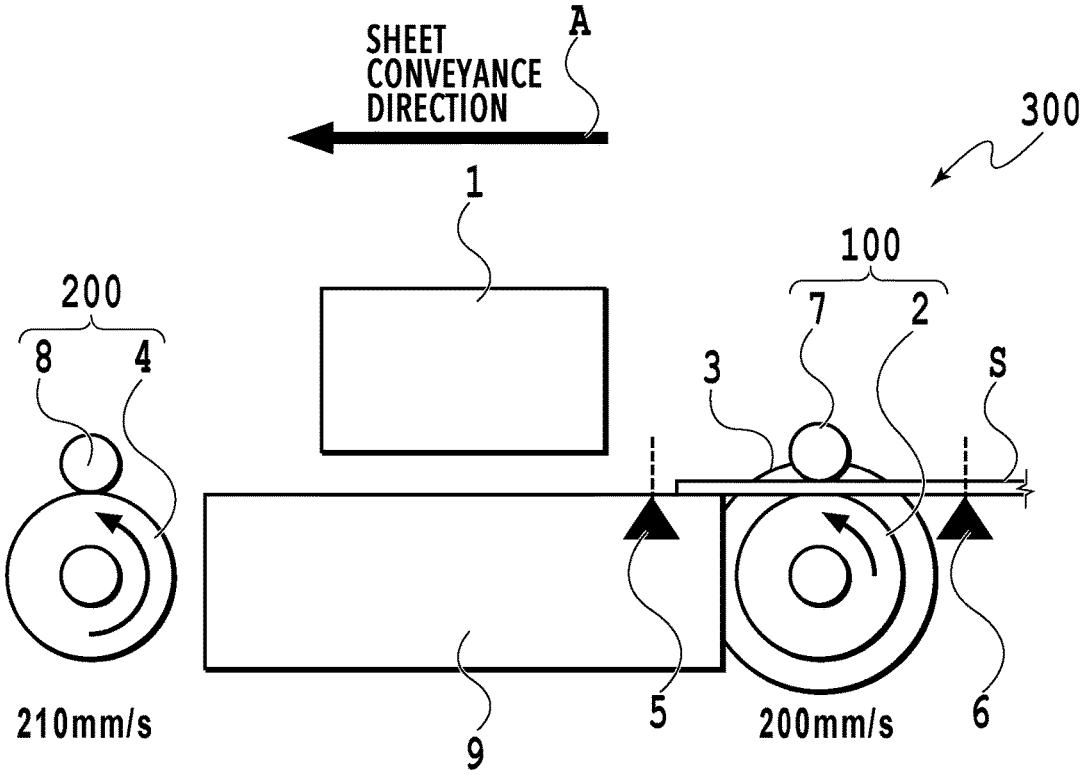
FIG. 1 is a cross-sectional view schematically showing a rough configuration of a printing apparatus for conveying a print medium in a first embodiment according to the present invention.

FIG. 1 is a cross-sectional view schematically showing the rough configuration of a printing apparatus 300 for conveying a print medium in a first embodiment.

A sheet S as a print medium is conveyed in a sheet conveyance direction A. A print head 1 serving as a print unit ejects ink droplets onto the sheet S in response to a signal based on image information so as to form an image. The present embodiment will be explained by way of a so-called line printer in which nozzles for ejecting ink droplets in a sheet width direction are securely arranged on the print head 1 so as to form an image while continuously conveying the sheet S. In the present embodiment, the print head 1 is provided with print heads 1Bk, 1C, 1M, and 1Y for ejecting black (Bk), cyan (C), magenta (M), and yellow (Y) ink so as to achieve full-color printing on the sheet S. These print heads 1Bk, 1C, 1M, and 1Y are arranged in the sheet conveyance direction A. Here, the number of colors, that is, the number of print heads, may be arbitrarily and desirably determined. Hereinafter, the print heads will be comprehensively referred to as the "print head 1."

Next, explanation will be made on the conveyance configuration of the sheet S. A sheet rear end detecting sensor 6, a conveyance roller pair (upstream roller pair) 100 serving as a first roller pair, a sheet front end detecting sensor 5, the print head 1, and a discharge roller pair (downstream roller pair) 200 serving as a second roller pair are arranged in order from upstream in a conveyance direction on the right on the drawing sheet of FIG. 1. A platen 9 that is provided with a suction fan, not shown, and can adsorb the sheet S is disposed opposite to the print head 1. The conveyance roller pair 100 includes a conveyance roller 2 and a pinch roller 7. Driving force from a conveyance motor 13 (see FIG. 2) is transmitted to the conveyance roller 2 to rotate and a conveyance force acts on the sheet S which is held at a nip between the conveyance roller 2 and the pinch roller 7 that come into contact with each other. Moreover, the discharge roller pair 200 includes a discharge roller 4 and a spur 8. The driving force from the conveyance motor 13 is transmitted to the discharge roller 4 to rotate like the conveyance roller pair 100 and a conveyance force acts on the sheet which is held by the discharge roller pair 200 and receives the conveyance force at a nip between the discharge roller 4 and the spur 8 that come into contact with each other. At this time, the conveyance speed of the sheet S caused by the rotation of the discharge roller 4 is about 5% higher than that caused by the rotation of conveyance roller 2. In this manner, the sag of the sheet S is suppressed between the conveyance roller pair 100 and the discharge roller pair 200 after the front end of the sheet S travels from the conveyance roller pair 100 to the discharge roller pair 200 in the process in which the sheet S is conveyed. This difference in conveyance speed may be set to a limit value at which the conveyance speed of the sheet S by the discharge roller pair 200 is not lower than that of the sheet S by the conveyance roller pair 100 from the viewpoint of part tolerance, or the conveyance speed of the sheet S by the discharge roller pair 200 may be increased by 10%.

Figure 2:
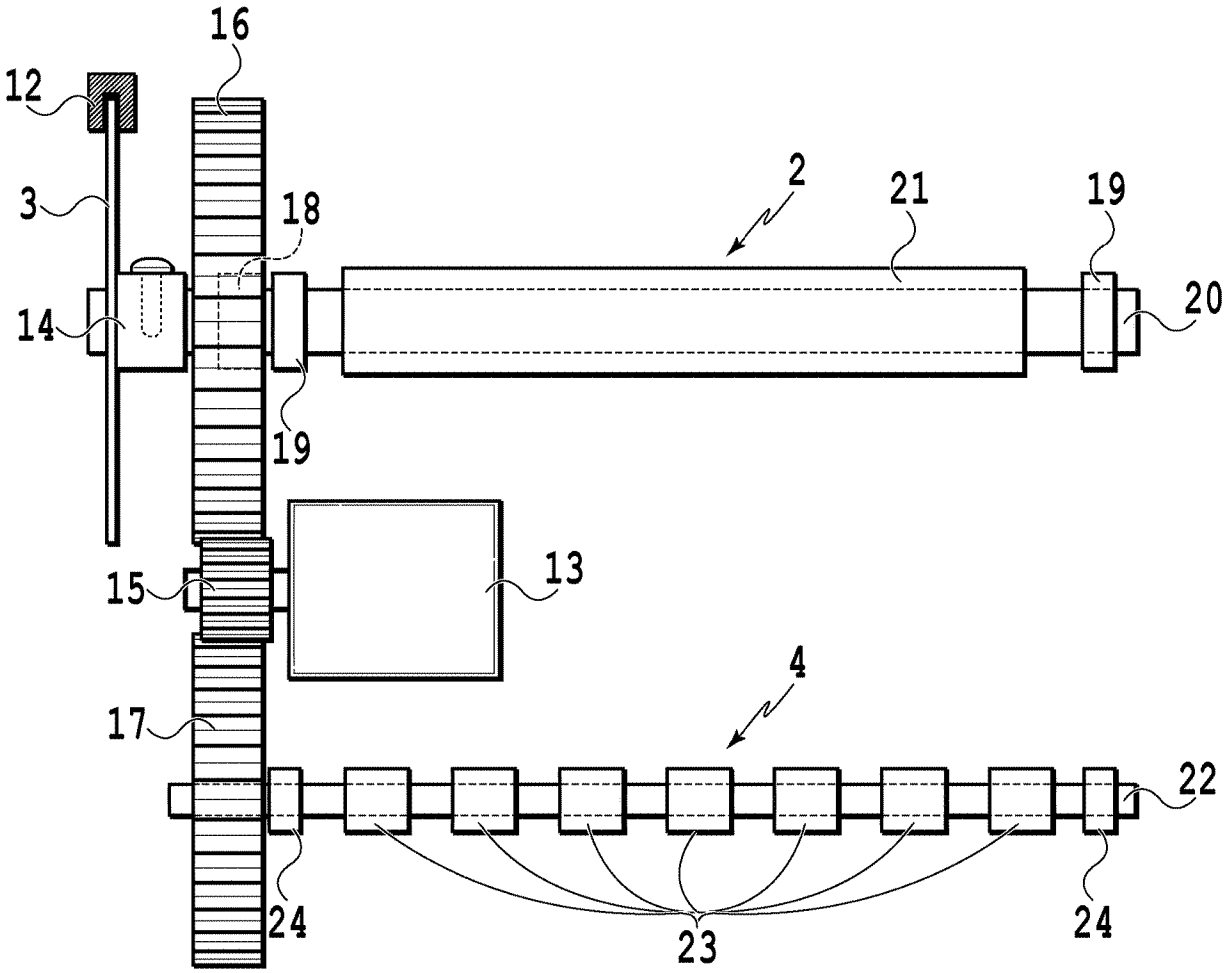
FIG. 2 is a schematic view showing the drive configuration of a conveyance roller pair and a discharge roller pair in the printing apparatus in the first embodiment according to the present invention.

FIG. 2 is a schematic view showing the drive configuration of the conveyance roller pair 100 and the discharge roller pair 200. The conveying roller 2 is provided with a rubber layer 21 formed on the surface of a shaft 20 made of metal such as SUS material and is rotatably supported by a bearing 19. The discharge roller 4 is provided with a plurality of rubber layers 23 formed in a divided state on the surface of a shaft 22 made of a metal such as SUS material and is rotatably supported by the bearing 24. To the conveyance roller 2 is fixed a code wheel 3 having a slit of a pitch in proportion to a resolution in forming an image via a code wheel fixing member 14. An encoder sensor 12 as an optical sensor can detect the slit of the code wheel 3, to thus detect the rotational speed of the conveyance roller 2 based on the detection result. The encoder sensor 12 detects the slit of the code wheel 3, thus determining the ink ejection timing of the print head 1. Furthermore, a conveyance roller gear 16 that receives driving force from the conveyance motor 13 is fixed to the conveyance roller 2. A one-way clutch 18 is fixed to the conveyance roller gear 16. The driving force of the conveyance motor 13 is transmitted to the conveyance roller 2 via the one-way clutch 18. When the front end of the sheet S reaches the discharge roller pair 200 and the sheet S is pulled by the discharge roller 4 at a speed higher than that of the conveyance roller 2 rotating through the conveyance roller gear 16, the conveyance roller 2 of the conveyance roller pair 100 holding the sheet S therebetween is adapted to idly rotate by the conveyance roller 2 being released from the locked state with the one-way clutch 18 to shut off the transmission of the driving force from the conveyance motor and rotate following the conveyance speed at which the discharge roller 4 conveys the sheet S. In other words, the conveyance roller pair 100 performs an idle rotation through the function of the one-way clutch 18 when the sheet S (print medium) held by the conveyance roller pair 100 is pulled to the downstream in the conveying direction. The sheet front end detecting sensor 5 is used for detecting the front end of the conveyed sheet S to start printing an image after predetermined conveyance of the sheet 200 by the conveyance roller pair 100. The sheet rear end detecting sensor 6 is used for detecting a timing at which ink ejection control is changed during printing according to the present invention.

Figure 3:
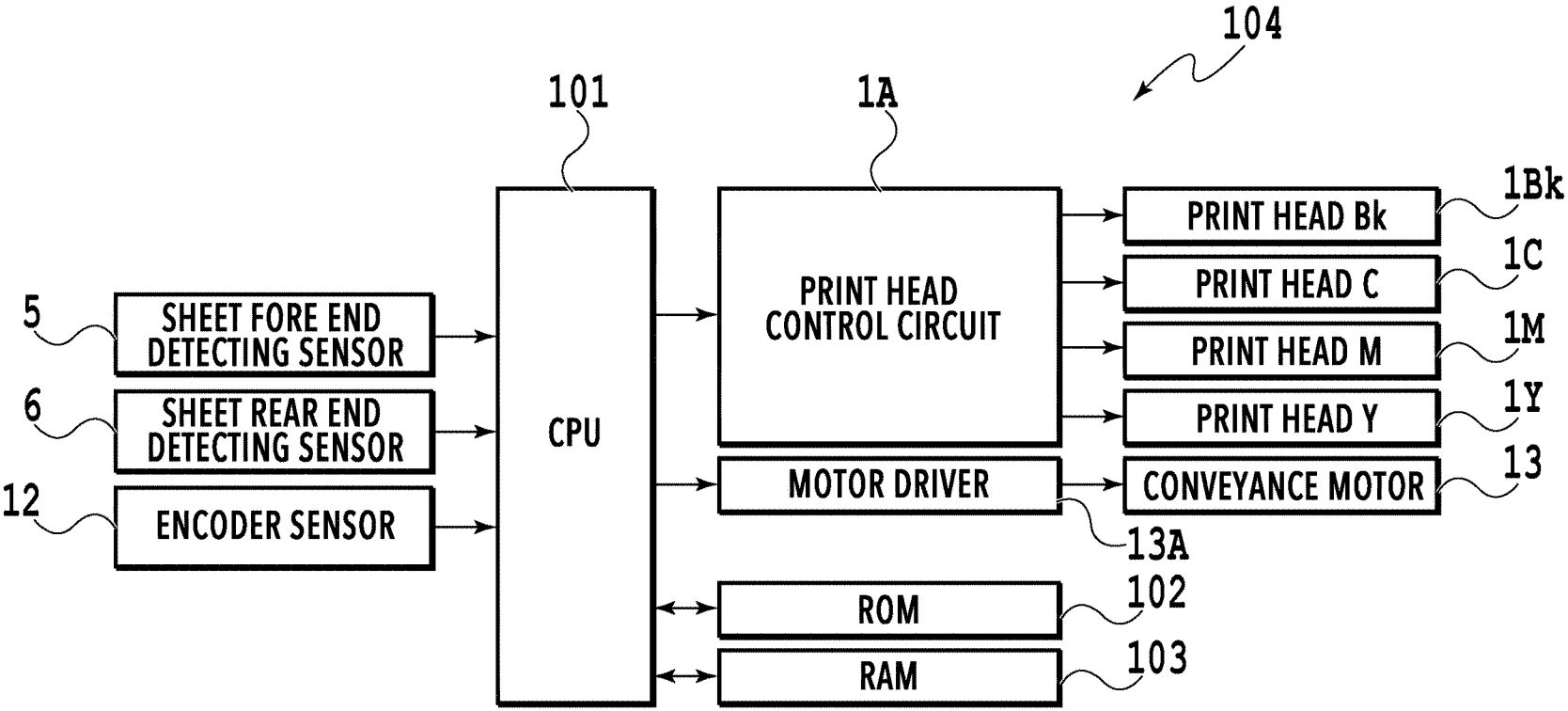
FIG. 3 is a block diagram illustrating the configuration of a control system in the printing apparatus in the first embodiment according to the present invention.

FIG. 3 is a block diagram illustrating the configuration of a control system in the printing apparatus according to the first embodiment. In FIG. 3, a CPU 101 of a control unit 104 in the printing apparatus 300 performs operation control processing of the printing apparatus 300, data processing, and the like. A ROM 102 stores therein programs used for performing the processing procedures. A RAM 103 serving as a storage unit is used as a work area during the processing. The CPU 101 controls the print head 1 and the conveyance motor 13 via a print head control circuit 1A and a motor driver 13A, respectively.

The CPU 101 of the control unit 104 receives signals output from the sheet front end detecting sensor 5, the sheet rear end detecting sensor 6, and the encoder sensor 12. The CPU 101 sends a signal to the motor driver 13A in accordance with programs stored in the ROM 102, and controls the conveying operation of the sheet S. Moreover, the CPU 101 performs image printing control by which ink is ejected from the print head 1 via the print head control circuit 1A in such a manner as to eject ink in response to a signal output from the encoder sensor 12. The RAM 103 is a storage unit capable of temporarily storing data or an arithmetic result. In the present embodiment, the RAM 103 determines an ink ejection timing to the sheet S that is held and conveyed by the discharge roller pair 200 that is not provided with a code wheel, and then, stores it therein.

Figure 4:
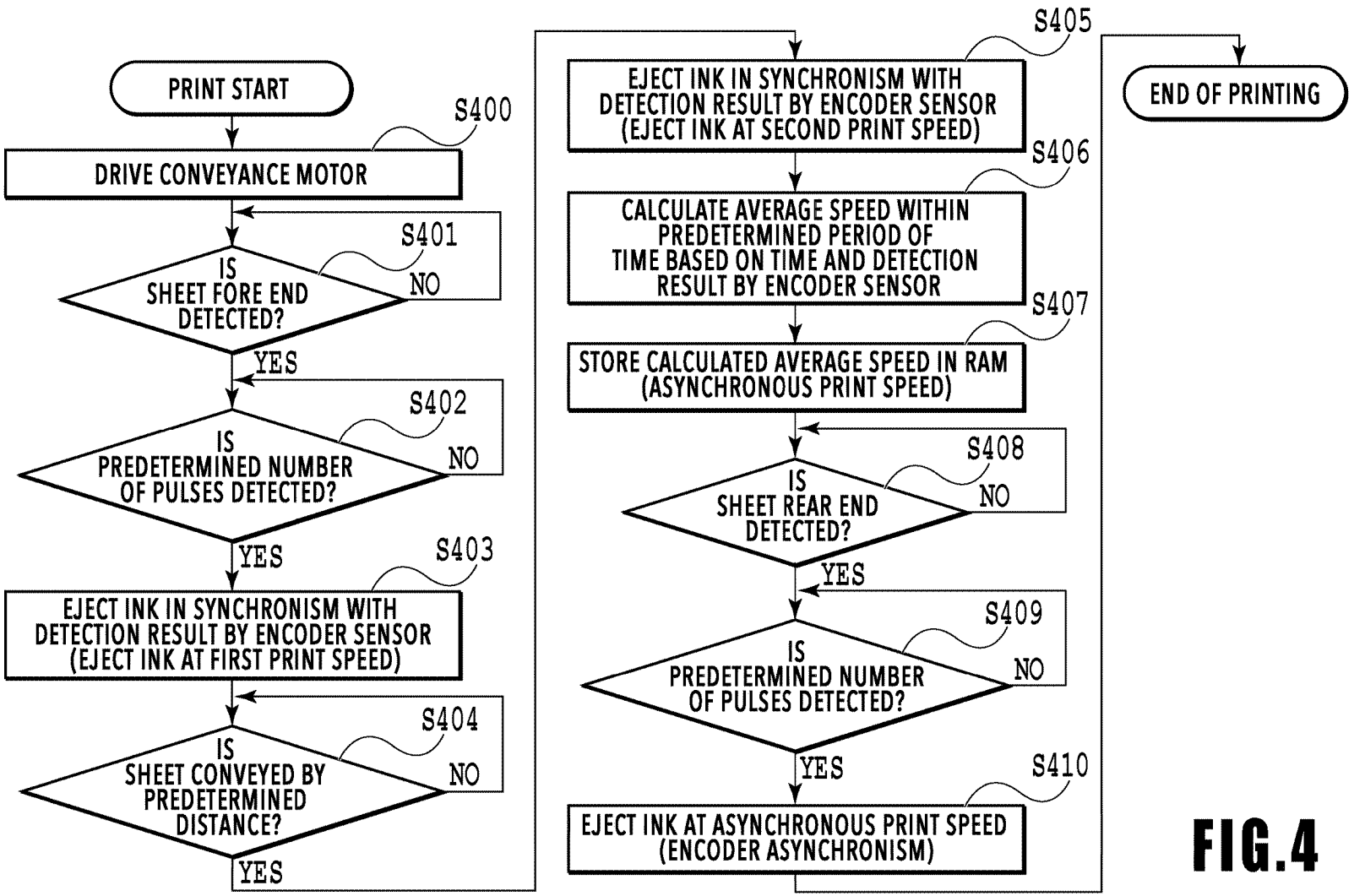
FIG. 4 is a flowchart illustrating liquid ejection control in the printing apparatus in the first embodiment according to the present invention.
Figure 5A:
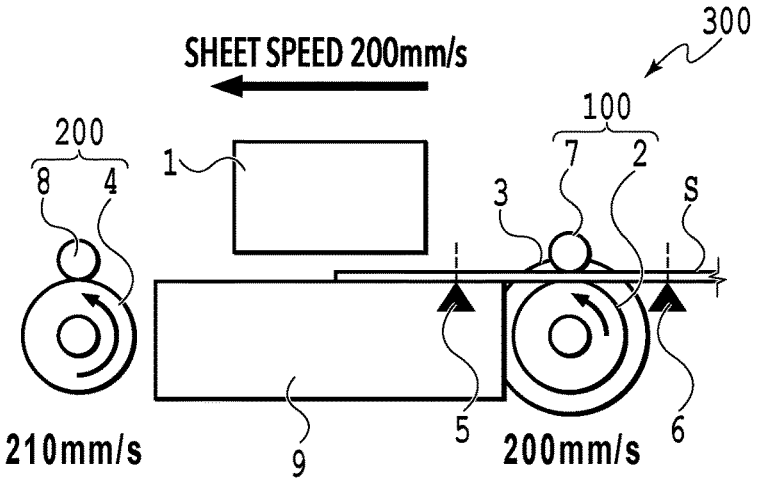
FIG. 5A to FIG. 5C are cross-sectional views schematically showing the conveyance of a print medium in the printing apparatus in the first embodiment according to the present invention.
Figure 5B:
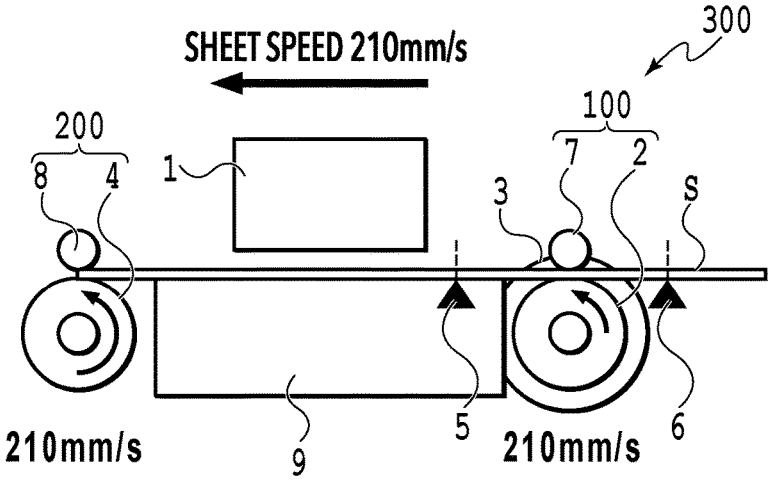
Figure 5C:
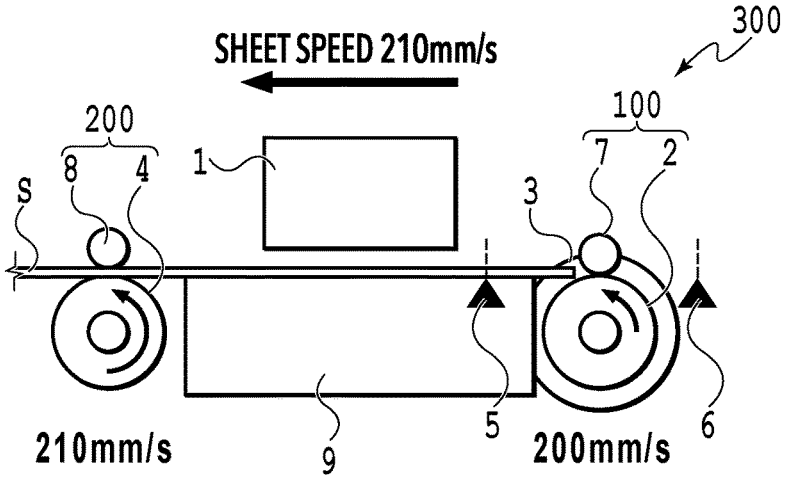
Figure 6:
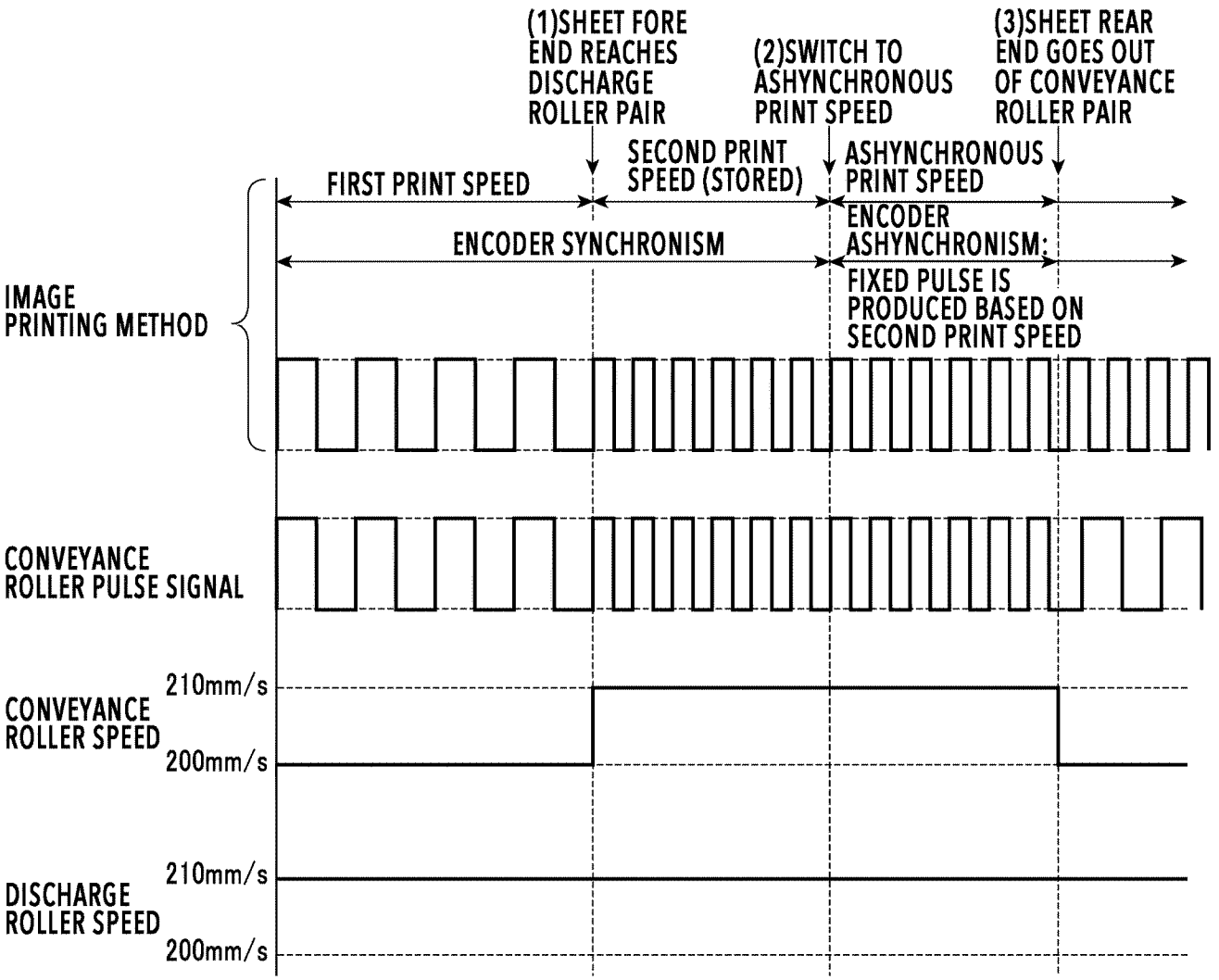
FIG. 6 is a timing chart in the printing apparatus in the first embodiment according to the present invention.

FIG. 4 is a flowchart illustrating a change of ink ejection control for image printing in the printing apparatus 300 in the first embodiment according to the present invention. Hereinafter, explanation will be made on change operations of the speed of each roller or the sheet S or the ink ejection control during image printing in accordance with this flowchart. FIG. 5A to FIG. 5C are cross-sectional views schematically showing the conveyance of a print medium in the printing apparatus in the first embodiment according to the present invention. Moreover, FIG. 6 is a timing chart in the printing apparatus of the first embodiment according to the present invention. First, it is assumed that before printing start, the sheet S stands by at an arbitrary position at which the sheet front end stays between the conveyance roller pair 100 and the sheet front end detecting sensor 5, as shown in FIG. 1. Upon the start of printing, the CPU 101 of the control unit 104 starts control for driving the conveyance motor 13 (see FIG. 3) (S400). More specifically, as shown in FIG. 5A, the conveyance roller 2 is driven such that the conveyance speed of the sheet S is 200 mm/s whereas the discharge roller 4 is driven such that the conveyance speed of the sheet S is 210 mm/s. The sheet S is conveyed from the standby position in the sheet conveyance direction A at 200 mm/s, which is the conveyance speed of the conveyance roller 2.

The CPU 101 of the control unit 104 determines whether or not the front end of the sheet S detects the sheet front end detecting sensor 5 (S401). If the determination is affirmative, the CPU 101 determines whether or not the predetermined number of pulses after the sheet S front end detection is detected by the encoder sensor 12 for detecting the code wheel 3 that is rotated in synchronism with the rotation of the conveyance roller 2 (S402). If the determination is affirmative, ink starts to be ejected (S403). The ink is ejected in synchronism with the rotation of the conveyance roller 2 at a conveyance speed of 200 mm/s, that is, in synchronism with a pulse output from the encoder sensor 12. A speed at an ink ejection timing in synchronism with an encoder pulse at this time is referred to as a first print speed.

Furthermore, the CPU 101 of the control unit 104 determines whether or not the sheet S is conveyed by a predetermined distance (the predetermined number of pulses) from the sheet front end detecting sensor 5 (S404). In step S404, as shown in FIG. 5B, a distance at which the front end of the sheet S to be conveyed by the conveyance roller pair 100 reaches the discharge roller pair 200 is referred to as a predetermined distance. Here, as shown in FIG. 5B, when the sheet S is held by both of the conveyance roller pair 100 and the discharge roller pair 200, the conveyance speed of the sheet S by the discharge roller pair 200 is higher than that by the conveyance roller pair 100, and therefore, the sheet S is pulled by the discharge roller pair 200. At this time, since the one-way clutch 18 is interposed in a transmission path from the conveyance motor 13 to the conveyance roller 2, the conveyance roller pair 100 idly rotates due to blocking of a driving force from the conveyance roller gear 16 by the one-way clutch 18. In addition, since the conveyance speed of the sheet S at this time follows the travel of the sheet S conveyed at a conveyance speed of 210 mm/s by the discharge roller pair 200, the conveyance speed by the conveyance roller pair 100 becomes 210 mm/s as well, as illustrated in the timing chart of FIG. 6. In the meantime, the ink is ejected at this time in synchronism with the rotation of the conveyance roller 2 at a conveyance speed of 210 mm/s following the travel of the sheet S, that is, in synchronism with a pulse output from the encoder sensor 12 (step S405). Here, a speed at an ink ejection timing in synchronism with the encoder pulse at this time is referred to as a second print speed. At this time, when an image is formed on the sheet S, the rotational speed of the conveyance roller 2 is fluctuated. However, the ink ejection during this period of time is synchronous with the encoder pulse output from the encoder sensor 12, that is, with the rotation of the conveyance roller 2. As a consequence, dots printed on the sheet S owing to the ink ejection do not basically mis-register in the conveyance direction. Mis-registration, if any, is so slight that it cannot be visually recognized.

Next, the CPU 101 of the control unit 104 detects the number of pulses in which the front end of the sheet S reaches the discharge roller pair 200 with using the encoder sensor 12 for detecting the code wheel 3 rotated in synchronism with the rotation of the conveyance roller 2. Thereafter, the conveyance speed is obtained based on the number of encoder pulses detected during predetermined conveyance and a time required for conveyance during the period of time (S406). More specifically, in the present embodiment, as illustrated in FIG. 6, an asynchronous print speed, described later, is determined in advance, the asynchronous print speed being switched by an ink ejection timing switch control performed after the rear end of the sheet S passes the sheet rear end detecting sensor 6 and before the rear end of the sheet S goes out of the conveyance roller pair 100. And then, the CPU 101 stores the conveyance speed determined in step S406 in the RAM 103 (S407). In the present embodiment, the CPU 101 calculates the average of the conveyance speeds during the predetermined period of time as 210 mm/s, which is equal to the conveyance speed by the discharge roller 4, and then, stores the average value of the conveyance speed therein. Here, the predetermined period of time during which the average of the conveyance speed is determined should be desirably a period of time during which the discharge roller 4 serving as a drive roller for the discharge roller pair 200 is rotated at least once, in view of a surface deviation of the discharge roller 4. The print speed at which the ink is ejected at a timing corresponding to the conveyance speed at this time is referred to as the asynchronous print speed. The ink ejection control at the asynchronous print speed is not performed in synchronism with a pulse from the encoder sensor 12 but is performed at a print speed timing calculated according to the sheet conveyance speed at this time. Incidentally, a pulse width can be varied according to the conveyance speed during printing in synchronism with the encoder pulse, and furthermore, the ink ejection is varied according thereto, so as to cope with a change in conveyance speed. However, during printing at the asynchronous print speed, a fixed pulse is produced according to the obtained conveyance speed, and thus, the ink is ejected from the print head 1 at each predetermined pulse.

The processing proceeds to step S408, in which the sheet S is conveyed, and the CPU 101 determines whether or not the rear end of the sheet S detects the sheet rear end detecting sensor 6. If the determination is affirmative, the processing proceeds to step S409. In contrast, if the determination is negative, the processing is repeated until the sheet rear end detecting sensor 6 is detected. In step S409, the CPU 101 determines whether or not the predetermined number of pulses is detected by the encoder sensor 12. If the determination is affirmative, the processing proceeds to step S410. In contrast, if the determination is negative, the sheet S is conveyed until the predetermined number of pulses is detected. The predetermined number of pulses at this time means the number of pulses in which the sheet S is conveyed by a distance after the rear end of the sheet S is detected by the sheet rear end detecting sensor 6 until it goes out of the conveyance position by the conveyance roller pair 100. In step S410, the ink ejection is switched at a timing to a conveyance speed according to the asynchronous print speed stored in the RAM 103 when the sheet S stays at a predetermined position between the sheet rear end detecting sensor 6 and the conveyance roller pair 100. More specifically, a pulse next to the last pulse of printing in synchronism with an encoder pulse at the reception of a switch command is switched to a fixed pulse, so that printing is performed at the asynchronous print speed. Thereafter, as shown in FIG. 5C, when the rear end of the sheet S goes out of the conveyance roller pair 100, the conveyance roller 2 loses a rotational speed of 210 mm/s that is the conveyance speed transmitted via the sheet S, and then, receives the driving force from the conveyance motor 13 by engaging of the one-way clutch 18, and thus, is rotated at a rotational speed of 200 mm/s that is its inherent conveyance speed. At this time, the sheet S is conveyed at a conveyance speed of 210 mm/s by the discharge roller 4. In this manner, after the rear end of the sheet S goes out of the conveyance roller pair 100 and until the conveyance speed of the sheet S by the rotation of the conveyance roller pair 100 is changed from 210 mm/s to 200 mm/s, the ink is ejected from the print head 1 at the asynchronous print speed that is stored in the RAM 103 and corresponds to a conveyance speed of 210 mm/s, and in the end, an image is printed.

As described above, the CPU 101 of the control unit 104 switches the ink ejection control at the first print speed and the second print speed to the ink ejection control at the asynchronous print speed before the rear end of the sheet S goes out of the conveyance roller pair 100. In this manner, even during the conveyance of the sheet S by both of the upstream and downstream roller pairs having different conveyance speeds from each other, favorable print accuracy from the front end of the sheet S to the rear end thereof can be maintained, thus making it possible to prevent any degradation of an image caused by a difference in speed between the upstream roller pair and the downstream roller pair.

In the present embodiment, the second print speed is stored at the timing after the front end of sheet S reaches the discharge roller pair 200 based on the detection result of the encoder sensor 12. However, a sheet end detecting sensor may be disposed downstream of the discharge roller pair 200, and the sheet end detecting sensor downstream of the discharge roller pair 200 may determine that the front end of sheet S reaches the discharge roller pair 200 without using the code wheel 3 or the encoder sensor 12.

Alternatively, the asynchronous print speed is switched while the rear end of the sheet S is conveyed from the sheet rear end detecting sensor 6 to the conveyance roller pair 100. However, the asynchronous print speed may be switched immediately after the asynchronous print speed is obtained, and thus, it may be switched anytime by the time that the rear end of the sheet S goes out of the conveyance roller pair 100.

Additionally, in the present embodiment, after the rear end of the sheet S goes out of the conveyance roller pair 100, the ink ejection is controlled at the asynchronous print speed based on the average conveyance speed obtained when the sheet S is conveyed while being respectively held by the conveyance roller pair 100 and the discharge roller pair 200. However, the asynchronous print speed is not limited to this average conveyance speed. For example, the CPU 101 acquires an encoder pulse detected by the encoder sensor 12 during a period of time during which the discharge roller 4 serving as a drive roller for the discharge roller pair 200 is rotated at least once when the sheet S is conveyed while being respectively held by the conveyance roller pair 100 and the discharge roller pair 200, and then, stores it in the RAM 103. Thereafter, after the sheet rear end goes out of the conveyance roller pair 100, the CPU 101 may control the ink ejection by using the stored encoder pulse as the asynchronous print speed without obtaining a conveyance speed.

Second Embodiment

Next, explanation will be made on a printing apparatus of a second embodiment according to the present invention. Explanation of constituent elements similar to those in the first embodiment will be omitted below.

Figure 7:
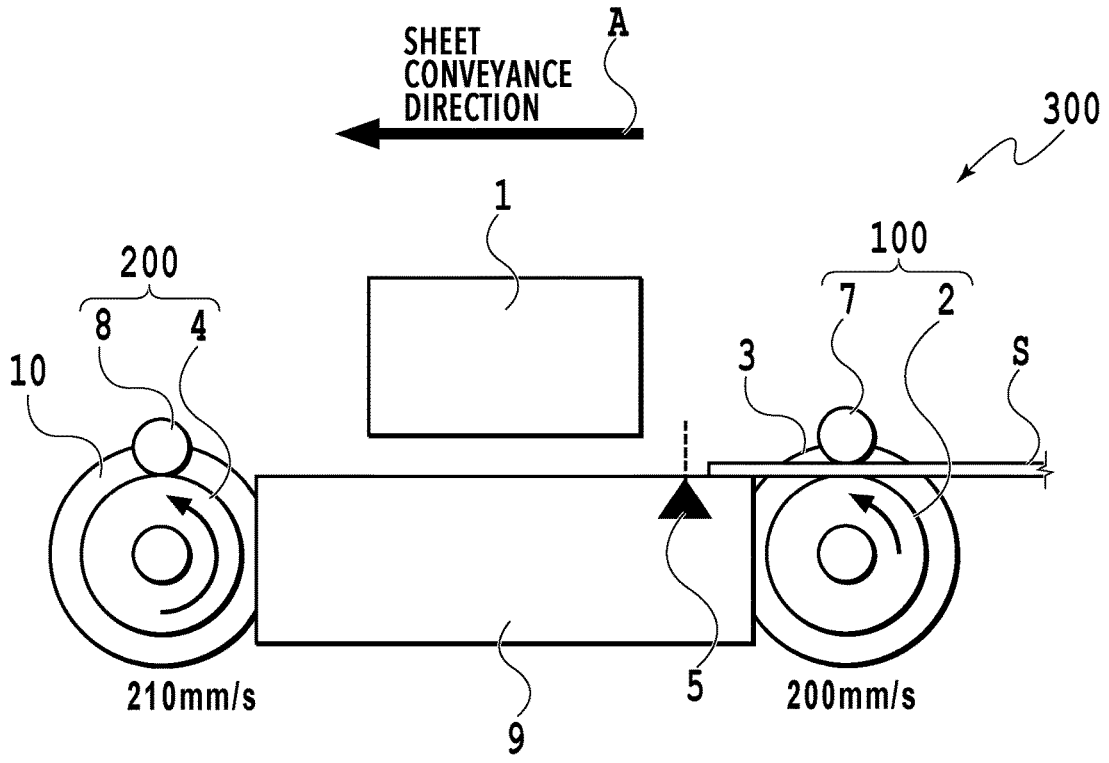
FIG. 7 is a cross-sectional view schematically showing a rough configuration of a printing apparatus in a second embodiment according to the present invention.

FIG. 7 is a cross-sectional view schematically showing the rough configuration of the printing apparatus in the second embodiment according to the present invention. In the second embodiment, as in the first embodiment, a one-way clutch 18 is fixed to a conveyance roller gear 16 to which the rotation of the conveyance motor 13 is transmitted, and the driving force of the conveyance motor 13 is transmitted via the one-way clutch 18, to the conveyance roller 2. Further the second embodiment is exemplified by the configuration of a so-called double-encoder further having a code wheel 10 attached to a discharge roller 4. An encoder sensor for a conveyance roller 2 is referred to as a first encoder sensor 3B (see FIG. 8) whereas an encoder sensor for the discharge roller 4 is referred to as a second encoder sensor 10B (see FIG. 8). In the second embodiment, even if an asynchronous print speed is obtained, ejection control is not required based on the obtained asynchronous print speed, unlike the first embodiment.

Figure 8:
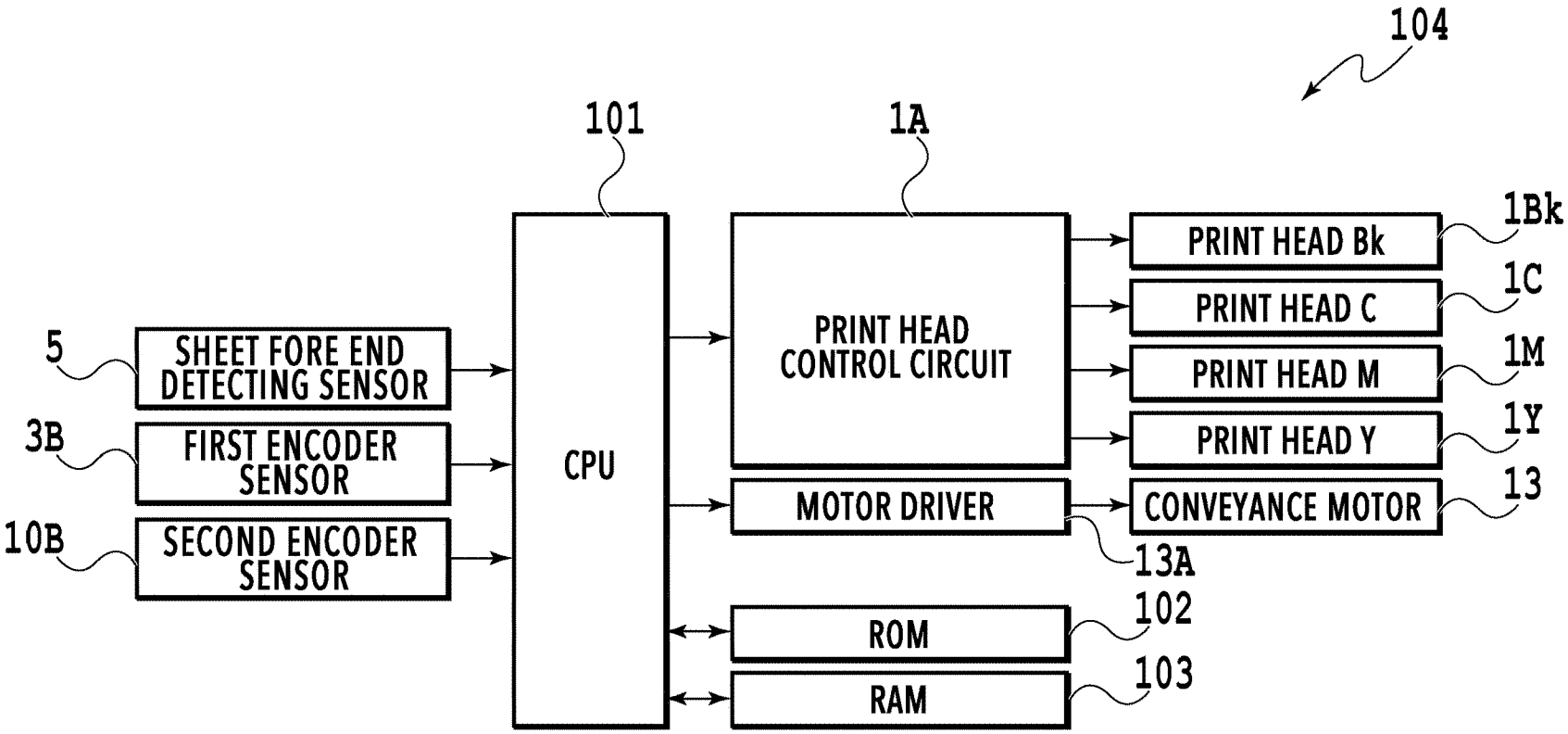
FIG. 8 is a block diagram illustrating the configuration of a control system of the printing apparatus in the second embodiment according to the present invention.

FIG. 8 is a block diagram illustrating the configuration of a control system of the printing apparatus in the second embodiment according to the present invention. In FIG. 8, a CPU 101 of a control unit 104 receives signals output from a sheet front end detecting sensor 5, the first encoder sensor 3B serving as a first rotation detecting unit, and the second encoder sensor 10B serving as a second rotation detecting unit. The CPU 101 sends a signal to a motor driver 13A in accordance with programs stored in a ROM 102, so as to control operation for conveying a sheet S. Moreover, the CPU 101 controls printing so as to eject ink from a print head 1 via a print head control circuit 1A in response to a signal output from each of the first encoder sensor 3B and the second encoder sensor 10B.

Figure 9:
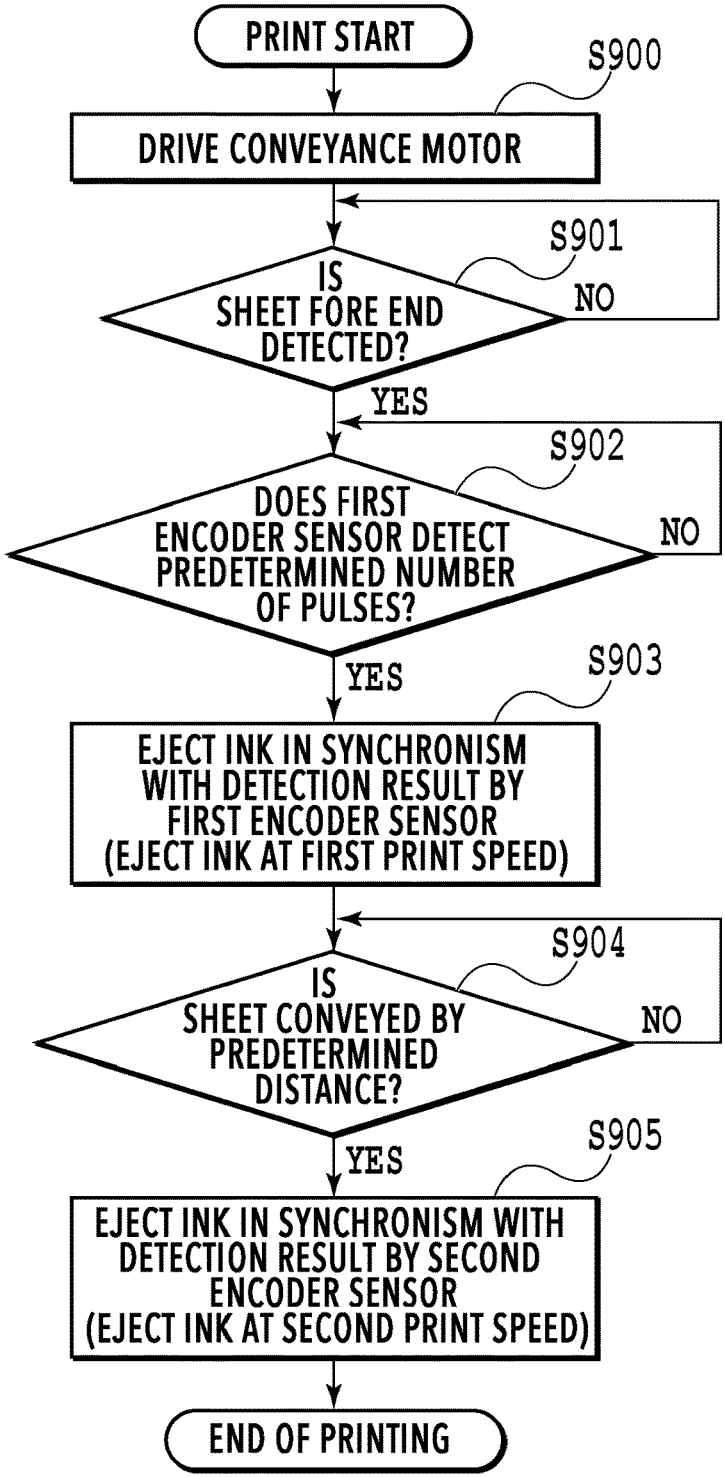
FIG. 9 is a flowchart illustrating liquid ejection control in the printing apparatus in the second embodiment according to the present invention.

FIG. 9 is a flowchart illustrating liquid ejection control in the printing apparatus in the second embodiment. Operations for changing the rotational speed of each roller, the conveyance speed of a sheet S, and ink ejection control during image printing will be explained below in accordance with the flowchart.

Here, operation until the sheet S reaches a discharge roller pair 200 to be held and conveyed in the second embodiment is the same as that in the first embodiment. However, the CPU 101 switches ink ejection control in response to a signal output from the first encoder sensor 3B to ink ejection control in response to a signal output from the second encoder sensor 10B after the sheet S reaches the discharge roller pair 200. The CPU 101 may switch the encoder sensors at any timing after the front end of the sheet S goes over the discharge roller pair 200 and before the rear end of the sheet S passes the conveyance roller pair 100. It is desirable to switch the encoder sensors with a delay of the predetermined number of pulses after the start of conveyance by both of the roller pairs by the time that the conveyance speeds of both of the roller pairs are stabilized.

Figure 10:
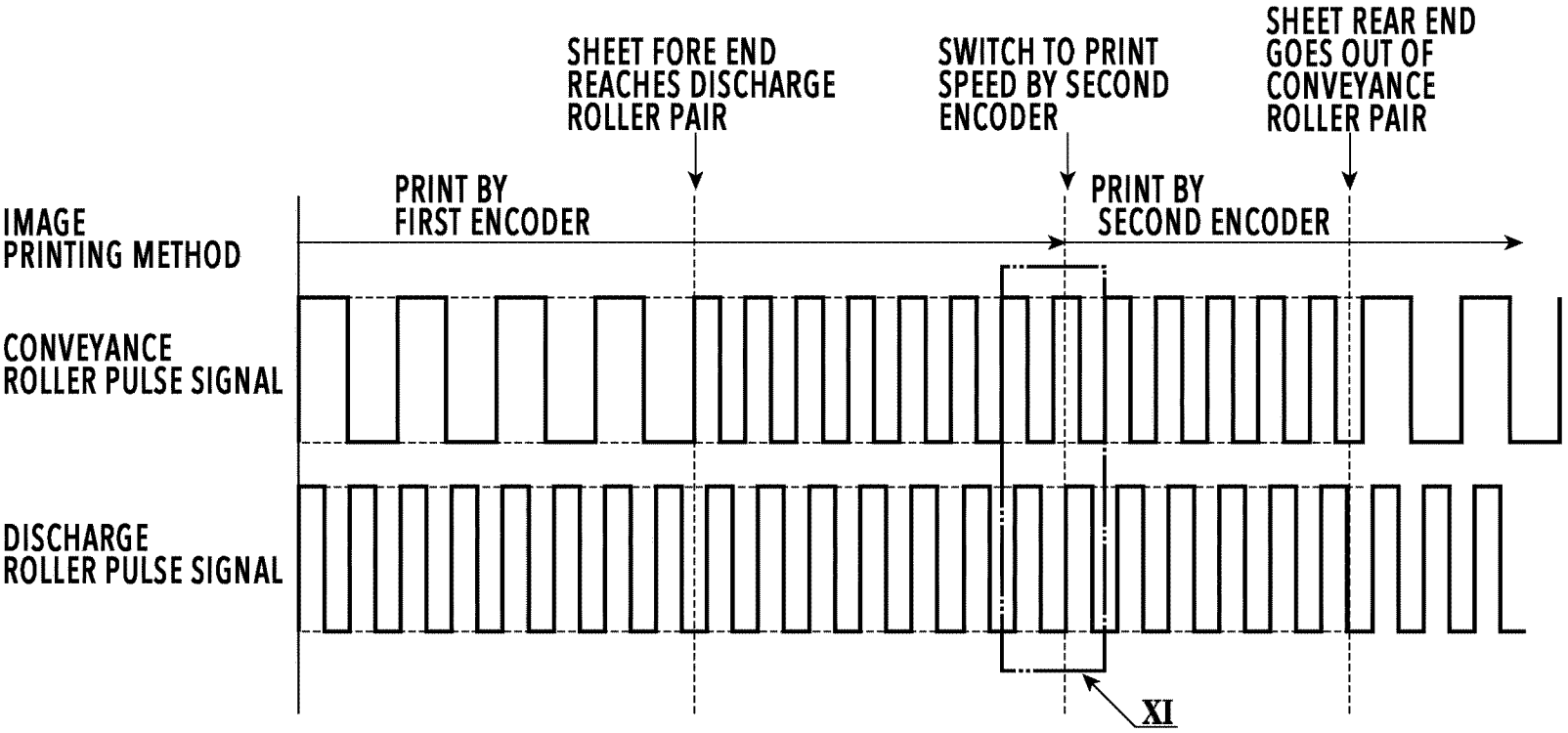
FIG. 10 is a timing chart illustrating a switch timing for printing by two encoders in the printing apparatus in the second embodiment according to the present invention.
Figure 11:
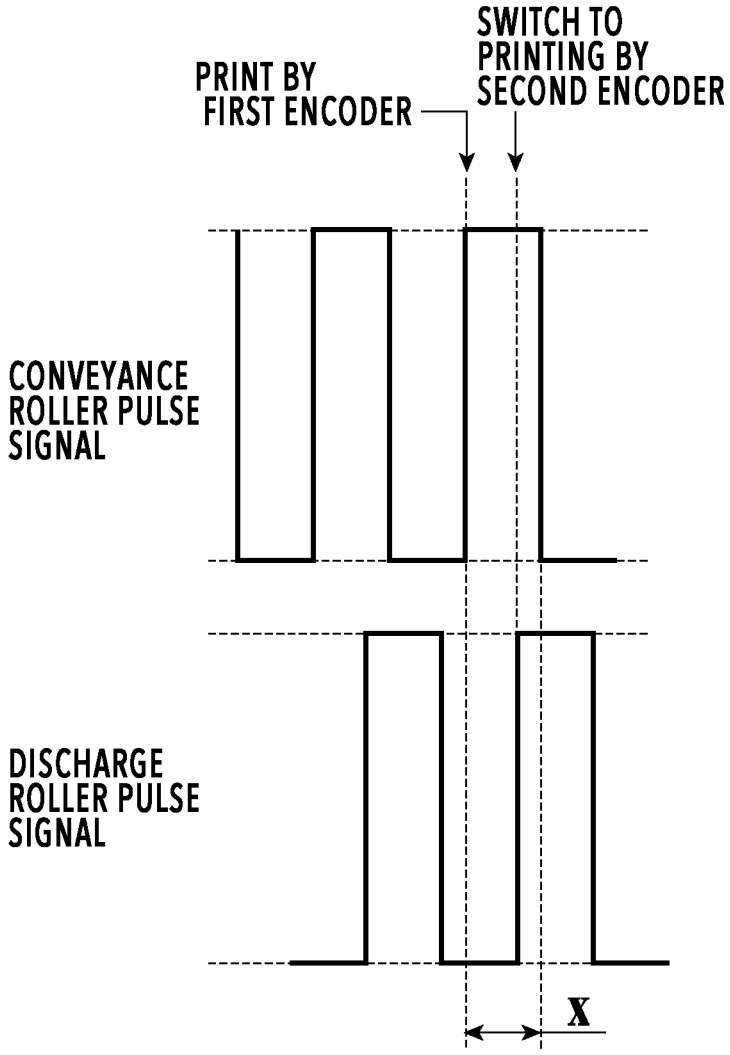
FIG. 11 is a partly enlarged timing chart of FIG. 10, illustrating a switch timing from a print speed of a first encoder to a print speed of a second encoder.

FIG. 10 is a timing chart illustrating switch timings for printing by the two encoders. When the front end of a sheet S reaches the discharge roller pair 200, the first encoder performs image printing while a conveyance speed increases in response to a conveyance roller pulse signal illustrated in FIG. 10, like in the first embodiment. Thereafter, after the rear end of the sheet S goes out of the conveyance roller pair 100, the conveyance roller 2 is released from a driven state so that its rotational speed is restored. Before the restoration of the rotational speed, the CPU 101 switches the current printing to synchronous printing by the second encoder during printing in synchronism with the first encoder. The switch to the synchronous printing between the first encoder and the second encoder will be described with reference to FIG. 11. FIG. 11 is an enlarged view of a part of FIG. 10, and is an explanatory view explaining the timing of switching the printing speed of the first encoder to the printing speed of the second encoder. In a case where the CPU 101 detects the latest pulse width X (μm) of the conveyance roller encoder, the printing control is switched from the first encoder to the second encoder at a timing of rising of a pulse of the discharge roller encoder. In this manner, the switch is achieved with an error of at least one pulse. In the case of an image printing resolution of 1200 dpi, an error can be suppressed to about 22 μm at the maximum. This achieves an improvement in resolution or reduces a switch error by dividing one pulse.

As described above, the ink ejection control in synchronism with the first encoder 3B at the first print speed can be switched to the ink ejection control in synchronism with the second encoder 10B at the second print speed during printing. Even if the conveyance speed of the sheet is changed during the printing, the ink ejection can be kept with high accuracy. In this manner, it is possible to prevent the degradation of an image caused by a difference in speed between an upstream roller pair and a downstream roller pair.

Third Embodiment

Next, explanation will be made on a printing apparatus in a third embodiment. Explanation of constituent elements similar to those in the first embodiment will be omitted below.

Figure 12:
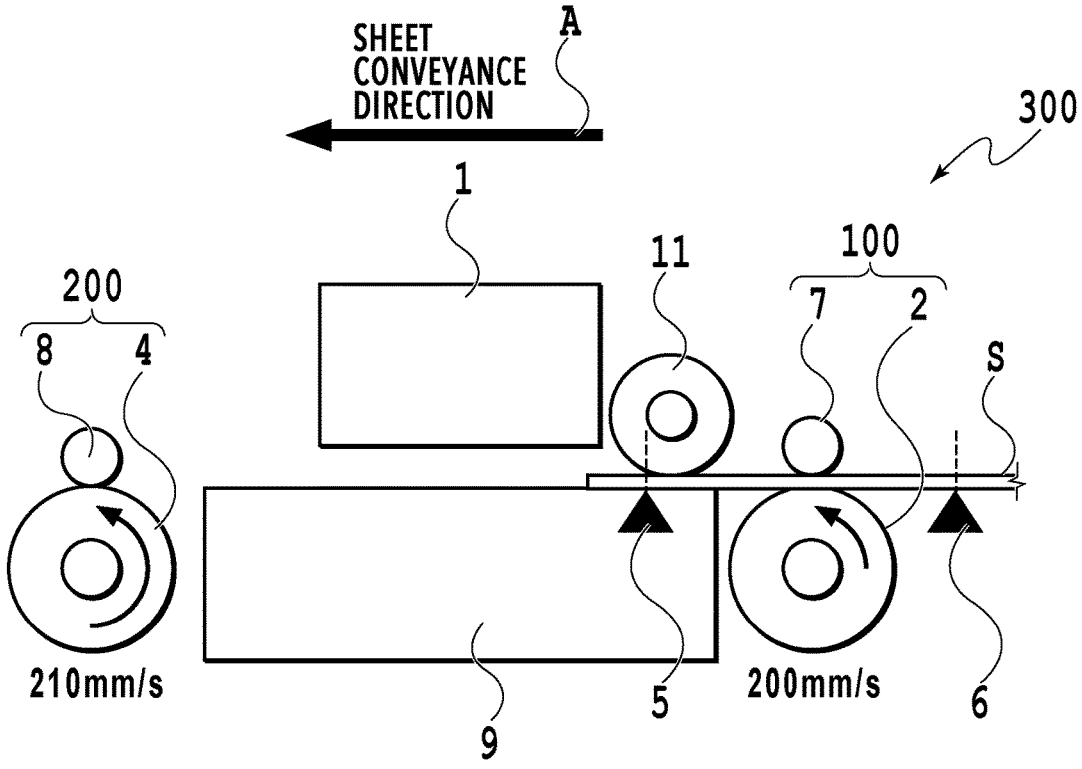
FIG. 12 is a cross-sectional view schematically showing a rough configuration of a printing apparatus for conveying a print medium in a third embodiment according to the present invention.

FIG. 12 is a cross-sectional view schematically showing the rough configuration of the printing apparatus for conveying a print medium in the third embodiment according to the present invention. In the third embodiment, as in the first embodiment, a one-way clutch 18 is fixed to a conveyance roller gear 16 to which the rotation of the conveyance motor 13 is transmitted, and the driving force of the conveyance motor 13 is transmitted via the one-way clutch 18 to the conveyance roller 2.

A third encoder 11 is mounted on a platen 9. A control system is the same as that in the first embodiment. The third encoder 11 may be disposed anywhere between a print head 1 and conveyance roller pair 100. When the third encoder 11 is disposed near the print head 1, as shown in FIG. 12, the conveyance accuracy can be further enhanced because disturbance during conveying is reduced. In this manner, it is possible to reduce the degradation of an image caused by a difference in speed between an upstream roller pair and a downstream roller pair.

Fourth Embodiment

Subsequently, explanation will be made on a printing apparatus in a fourth embodiment. Explanation of constituent elements similar to those in the first and second embodiments will be omitted below.

Figure 13:
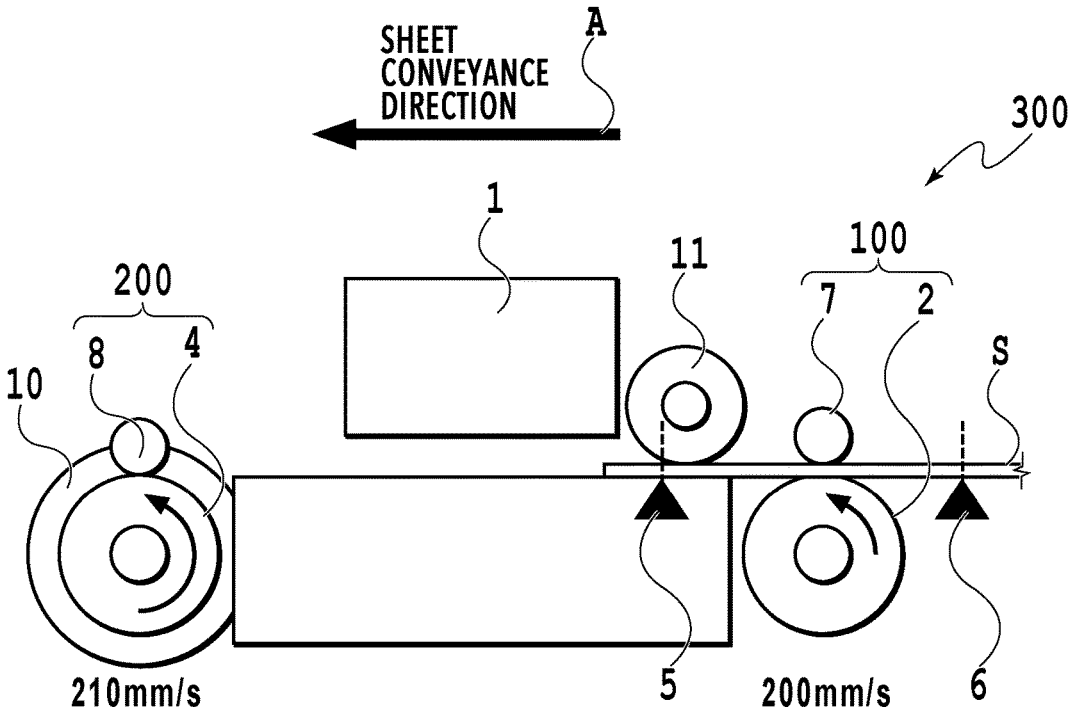
FIG. 13 is a cross-sectional view schematically showing a rough configuration of a printing apparatus for conveying a print medium in a fourth embodiment according to the present invention.

FIG. 13 is a cross-sectional view schematically showing the rough configuration of the printing apparatus for conveying a print medium in the fourth embodiment according to the present invention. The configuration is achieved by combining the second embodiment with the third embodiment. A third encoder 11 disposed between the print head 1 and the conveyance roller pair 100 is used, and a second code wheel 10 is provided for a discharge roller 4, and a control system is the same as that in the second embodiment. With this configuration, ink ejection control in synchronism with the third encoder 11 at a first print speed can be switched to ink ejection control in synchronism with a second encoder 10B at a second print speed during image printing. Moreover, as shown in FIG. 13, the third encoder 11 is disposed near a print head 1, thus reducing disturbance during conveying so as to enhance conveyance accuracy. In this manner, it is possible to reduce the degradation of an image caused by a difference in speed between an upstream roller pair and a downstream roller pair.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131167, filed Jul. 4, 2017, and No. 2018-118969, filed Jun. 22, 2018, which are hereby incorporated by reference herein in their entirety.

What is claimed is:

1. A printing apparatus comprising:

a print head for ejecting liquid onto a print medium;

a first roller pair disposed upstream of the print head with respect to a conveyance direction of the print medium, the first roller pair conveying the print medium to an ejection position of the print head at a first conveyance speed by a transmitted driving force while the first roller pair holds the print medium therebetween, and the first roller pair idly rotating by the print medium being held by the first roller pair and being pulled downstream in the conveyance direction;

a second roller pair disposed downstream of the print head with respect to the conveyance direction, the second roller pair conveying the print medium downstream in the conveyance direction at a second conveyance speed that is higher than the first conveyance speed while holding the print medium therebetween;

a first rotation detecting unit configured to detect information about the rotational speed of a roller in the first roller pair; and a control unit configured to control the print head so as to perform an ejection operation at an ejection timing based on a detection result by the first rotation detecting unit, in a case in which the second roller pair does not hold the print medium and the first roller pair conveys the print medium at the first conveyance speed, and in a case in which the second roller pair holds the print medium to convey the print medium at the second conveyance speed and the first roller pair holds the print medium conveyed by the second roller pair and idly rotates.

2. The printing apparatus according to claim 1, wherein the driving force is transmitted to the first roller pair via a one-way clutch.

3. The printing apparatus according to claim 1, wherein the control unit determines a conveyance speed for the print medium to be conveyed based on a detection result by the first rotation detecting unit in a case in which the second roller pair holds the print medium to convey the print medium at the second conveyance speed and the first roller pair idly rotates while holding the print medium conveyed by the second roller pair, and then, controls the ejection timing of the print head with respect to the print medium to be conveyed based on the determined conveyance speed in a case in which the first roller pair does not hold the print medium and the second roller pair holds the print medium to convey the print medium.

4. The printing apparatus according to claim 3, wherein the determined conveyance speed is a speed at which the print medium is conveyed during at least one rotation of a roller on a drive side of the second roller pair in a case in which the first roller pair is idly rotating.

5. The printing apparatus according to claim 1, wherein the control unit is configured to store the information detected by the first rotation detecting unit in a case in which the second roller pair holds the print medium to convey the print medium at the second conveyance speed and the first roller pair idly rotates while holding the print medium conveyed by the second roller pair, and is configured to control the ejection timing of the print head with respect to the print medium based on the information in a case in which the first roller pair does not hold the print medium and the second roller pair holds the print medium to convey the print medium.

6. The printing apparatus according to claim 5, wherein the information is information to be detected by the first rotation detecting unit during at least one rotation of a roller on a drive side of the second roller pair in a case in which the first roller pair idly rotates.

7. The printing apparatus according to claim 1, further comprising a second rotation detecting unit configured to detect information about the rotational speed of a roller of the second roller pair, wherein the control unit is configured to control the ejection operation based on a detection result of the first rotation detecting unit when the first roller pair is idly rotating before the rear end of the print medium passes the first roller pair, and the control unit is configured to control the ejection operation based on a detection result of the second rotation detecting unit when the rear end of the print medium passes the first roller pair.

* * * * *